US006401495B2

(12) United States Patent
Eppler et al.

(10) Patent No.: US 6,401,495 B2
(45) Date of Patent: Jun. 11, 2002

(54) SINKER FOR A KNITTING MACHINE OPERATING ACCORDING TO THE RELATIVE TECHNIQUE AND KNITTING MACHINE EQUIPPED WITH SUCH A SINKER

(75) Inventors: Hans-Martin Eppler, Messstetten; Dietmar Traenkle, Balingen, both of (DE)

(73) Assignee: SIPRA Patententwicklungs- und Beteiligungsgesellschaft mbH, Albstadt (DE)

( * ) Notice: Subject to any disclaimer, the term of this patent is extended or adjusted under 35 U.S.C. 154(b) by 0 days.

(21) Appl. No.: 09/812,320

(22) Filed: Mar. 20, 2001

(30) Foreign Application Priority Data

Mar. 29, 2000 (DE) ..... 100 15 730

(51) Int. Cl.[7] ..... D04B 15/06
(52) U.S. Cl. ..... 66/106
(58) Field of Search ..... 66/104, 106, 109, 66/91, 92, 93

(56) References Cited

U.S. PATENT DOCUMENTS 3,643,472 A * 2/1972 Apprich ..... 66/106
4,576,018 A * 3/1986 Schindele ..... 66/106
4,584,851 A * 4/1986 Palth ..... 66/106
4,608,841 A * 9/1986 Buck et al. ..... 66/106
4,693,092 A * 9/1987 Plath ..... 66/106
4,741,181 A * 5/1988 Plath ..... 66/106
4,751,829 A * 6/1988 Plath ..... 66/106
6,082,142 A * 7/2000 Kowitz ..... 66/106

FOREIGN PATENT DOCUMENTS

DE 3108041 * 9/1982 ..... 66/106
DE 3246512 * 6/1984 ..... 66/106
DE 3330530 * 3/1985 ..... 66/106

* cited by examiner

*Primary Examiner*—Danny Worrell
(74) *Attorney, Agent, or Firm*—Michael J. Striker

(57) ABSTRACT

A sinker (50) for a knitting machine operating according to the relative technique is described. The sinker (50) contains a front (32), a back (33), a head (34) arranged on one end and having a sinker throat (35) and a knock-over edge (36), a control butt (38) intended to make possible movements in a longitudinal direction (v) and protruding from the front (32), and at least one rocking element (39, 40) designed to make possible pivot movements transverse to the longitudinal direction (v) and provided on the front (32). According to the invention, the sinker (50) also has a spring element (41) intended to compensate for manufacturing inaccuracies, acting transverse to the longitudinal direction (v) (FIG. 4). A knitting machine equipped with such a sinker (50) is also described.

17 Claims, 6 Drawing Sheets

SINKER FOR A KNITTING MACHINE OPERATING ACCORDING TO THE RELATIVE TECHNIQUE AND KNITTING MACHINE EQUIPPED WITH SUCH A SINKER

BACKGROUND OF THE INVENTION

The invention concerns a sinker for a knitting machine that operates especially according to the relative technique, comprising a front, a back, a head arranged on one end and having a sinker throat and a knock-over edge, a control butt designed to make possible movements in a longitudinal direction and protruding from the front, and at least one rocking element designed to make possible pivot movements transverse to the longitudinal direction and provided on the front side. The invention also concerns a knitting machine equipped with such a sinker.

In a knitting machine operating according to the relative technique, the knock-over and holding-down sinkers are pushed, during a drawing-down movement of the knitting needles occurring after thread take-up, in a direction opposite to his movement. The needle stroke required to form a stitch is then smaller than during use of the normal knitting technique, which permits the use of less steep raising and take-off cam pars for the needles and sinkers and thus an increase in knitting speed.

Known knitting machines operating according to the relative technique of the generic type just mentioned are generally designed as circular knitting machines (DE 33 11 361 C2, DE 33 48 030 C2, DE 33 30 530 C1) and are mostly provided with sinkers designed as two-arm levers. These are pivotally mounted by means of central bearing sites on the bottoms of grooves formed in a needle cylinder or the like and can be displaced in their longitudinal direction. Their pivot movements are produced by means of swivelling cam parts that act on rocking elements provided on the front sides of the sinkers and frequently designed in the fashion of butts. These movements occur, in the case of a circular knitting machine, in a radial direction relative to the needle cylinder axis.

SUMMARY OF THE INVENTION

A problem that occurs during operation of such circular knitting machines consists of the fact that the swivelling cam parts, because of unavoidable tolerances during manufacture, must be adjusted relative to each other so that the sinkers are arranged with a certain play, i.e., are mounted to pivot transverslye to the longitudinal direction by the amount of this play. For this purpose, during adjustment of the machine for instance, one (the upper) swivelling cam part is adjusted so that it fixes the position of the sinkers in a position pivoted maximally toward the needle cylinder. The other (lower) swivelling cam part is then adjusted so that it fixes the positions of the sinkers in a position pivoted maximally away from the needle cylinder with a chosen play of, say, 0.2 to 0.5 mm. Because of this, on the one hand, additional working steps are required during setup of the machine and, on the other hand, the mentioned play results in unsteady running of the sinkers and thus undesired clattering noises during operation.

Knitting machines operating according to the relative technique and sinkers of the generic type just mentioned are also known, in which the knock-over and holding-down sinkers are biased by an elastic spring force in the direction toward an end position of their transverse movement. The spring force is applied by means of an endless annular or tension spring, enclosing the needle cylinder of a circular knitting machine and acting on the front sides of the sinkers. Since this spring biases the corresponding lever arms of the sinkers in the direction of the corresponding sinker carrier, either sinkers in the form of two-arm levers must be provided even if only one active swivelling cam part is present (DE 32 46 512 C2), or the swivelling cam part must be formed on the sinker carrier (DE 31 08 041 C2). This type of spring must also be suitable to act on all sinkers present, for which reason its spring force must be very large. Above all, however, the problem arises that the sinkers easily enter between two adjacent turns of the spring and are then jammed instead of being biased by the spring. Both variants lead to arrangements that are not satisfactory in a design respect, unfavorably influence the design height of the cam arrangements, and are prone to breakdown.

Corresponding problems can develop in knitting machines, in which the sinkers are supposed to be pivotable back and forth for reasons other than those just mentioned.

One object of this invention is, therefore, to design a sinker of the kind specified above so that if mounted in a knitting machine, an adjustment of a defined bearing clearance for the sinker is not required.

A further object of this invention is to design the sinker such that an adjustment of a defined bearing clearance for the sinker is not required even if unavoidable and other manufacturing tolerances occur.

Yet another object of this invention is the design of a sinker having, in dependance on its configuration, a favorable design height.

A further object underlying this invention is to provide a knitting machine with sinkers of the kind specified above such that an adjustment of a defined bearing clearance of the sinkers with respect to the cam arrangement of the knitting machine is not required.

And yet another object of the invention is to design the sinkers of a knitting machine operating according to the relative technique in such a manner that no undesired vibration and noise development occurs during operation of the knitting machine.

These and other objects are solved in accordance with this invention by means of a sinker of the kind specified above which is characterized by the fact that it has a spring element acting transversely to the longitudinal direction.

A knitting machine according to one embodiment of this invention is characterized by sinkers each either having a rocking element being arranged between said head and a bearing site intended for being supported on a carrier and provided on the back, wherein said spring element has a support site arranged between said head and said pivot site or having a bearing site being intended for support on a carrier, provided on the back and arranged between the head and said rocking element, wherein said spring element has a support site for being supported on a carrier of the machine, said support site lying on a side of said rocking element facing away froom said bearing site.

A knitting machine according to a further embodiment of the invention is characterized by by sinkers being provided with two rocking elements arranged on the front and spaced in the longitudinal direction, wherein the spring element has a support site for being supported on a carrier of the machine and being arranged in the longitudinal direction between the two rocking elements.

A knitting machine according to another embodiment of the invention is characterized by sinkers being provided with two rocking elements spaced in the longitudinal direction and arranged on the front, wherein a bearing site is situated in the longitudinal direction between said rocking elements, but on the back.

The invention provides the advantage that the sinkers themselves are set up to compensate for the manufacturing tolerances. For this reason, regardless of their design selected in the individual case, both tension springs and swiveling cam parts situated in the sinker carrier can be avoided and proven knitting machine designs can be retained.

The invention is further explained below in conjunction with the accompanying drawings by means of practical examples. In the drawings:

DETAILED DESCRIPTION OF THE PREFERRED EMBODIMENTS

Figure 1:
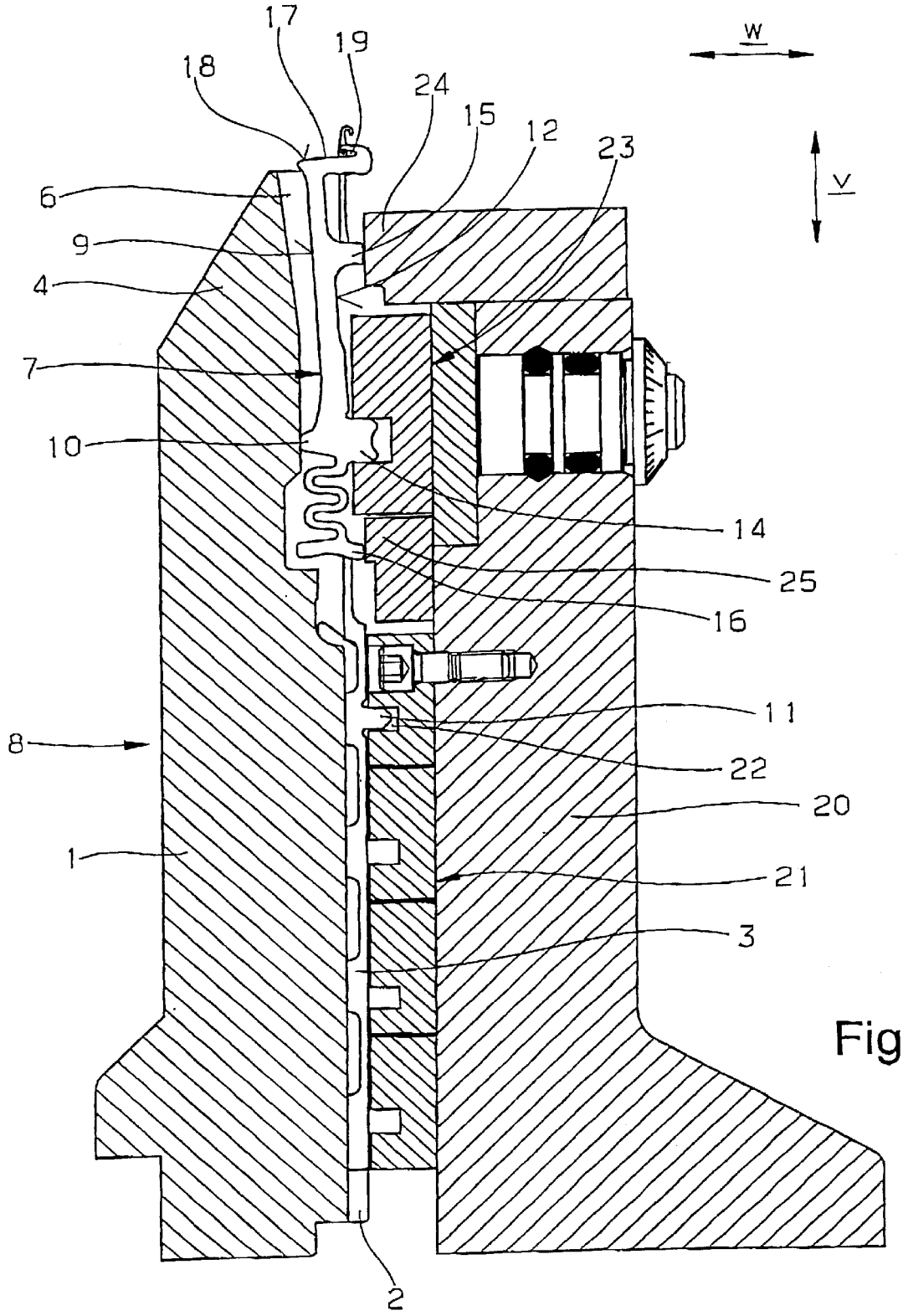
FIG. 1 shows a schematic axial section through the needle cylinder, a corresponding sinker cylinder and the cam arrangement of a circular knitting machine operating according to the relative technique.

The circular knitting machine chosen as practical example of the invention and depicted in the drawing contains a rotatable needle cylinder 1, whose outer surface is equipped in known fashion with guide walls or webs 2 ruing parallel to its axis for knitting needles 3 inserted between them, for example, ordinary latch-type needles. A sinker cylinder 4 is arranged above needle cylinder 1, coaxial to it and designed, for example, as part of it. The sinker cylinder 4 is also provided on its outer surface with axiparallel guide walls or webs 6, between which knock-over and holding-down sinkers 7, hereafter briefly called sinkers are mounted. The guide webs 2 and the guide webs 6 are provided with the same spacing, but are offset relative to each oiler in the peripheral direction by a half-spacing, so that the knitting needles 3 and sinkers 7 are arranged in alternation next to each other in a needle and sinker carrier 8 formed from cylinders 1 and 4, hereafter briefly called carrier arrangement 8.

The knitting needles 3 are displaceable in carrier arrangement 8 parallel to their longitudinal direction v (FIG. 1), i.e., parallel to the needle cylinder axis, and can therefore be moved up and down in FIG. 1 in the vertical direction. The sinkers 7 are mounted to be displaced in carrier arrangement 8, as is common during use of the relative technique, on the one hand, parallel to their longitudinal direction v, i.e., parallel to the needle cylinder axis, so that they can also be moved up and down in the vertical direction in FIG. 1. On the other hand, the sinkers 7 can also be pivoted back and forth transversely to this direction, i.e., in a radial direction w, for which purpose they are provided on their backs 9 with bearing sites 10 in the form of protruding shoulders or the like, which are supported on the bottoms of corresponding tricks formed by the guide webs 6.

Figure 3:
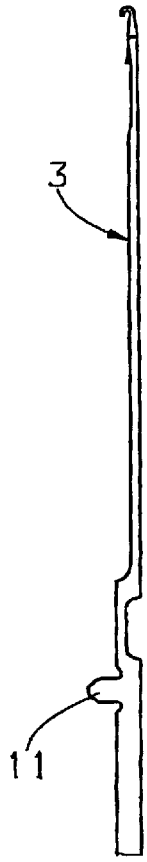
FIG. 3 shows an ordinary knitting needle for the circular knitting machine according to FIG. 1.

As shown in FIG. 3, in particular, the knitting needles 3 each have a protruding butt 11 on their front sides. On the other hand, the sinkers 7, according to FIG. 1, are provided on their front sides 12 with a protruding control butt 14 and, in the embodiment also with an upper and lower rocking element 15, 16 on both sides of this control butt 14, which rocking element generally is also designed as a protruding butt, but could also consist merely of the front face of the corresponding sinker 7. The sinkers 7 are also provided on an end projecting above the upper edge of carrier arrangement 8 with a head 17, which has a knock-over edge 18 and a sinker throat 19, as usual.

Figure 2:
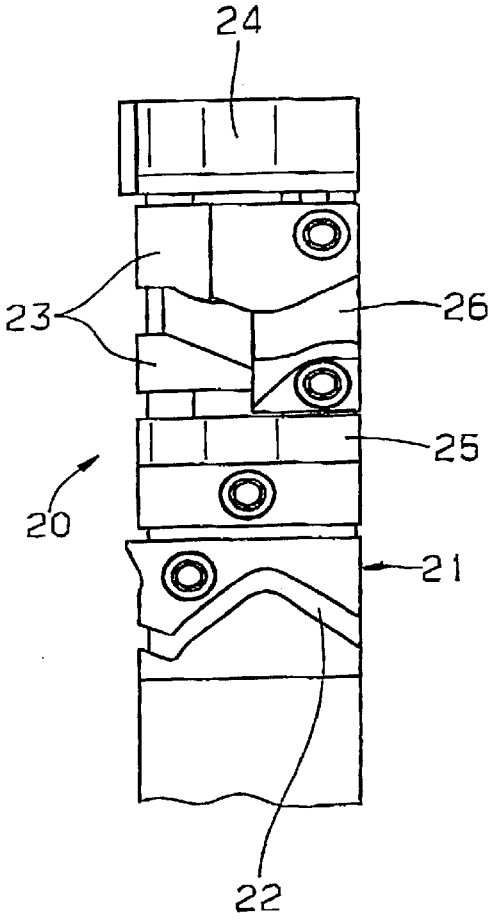
FIG. 2 shows a view of a system of the cam arrangement according to FIG. 1, viewed from the inside.

The carrier arrangement 8 is surrounded on its outside periphery by a cam arrangement 20 (FIGS. 1 and 2). On the one hand, this arrangement 20 has cam parts 21 that form the guide tracks 22 for the butts 11 of knitting needles 3. Several such cam parts 21 can be arranged one above the other in the longitudinal direction v, and allocated to butts 11, arranged in different planes of the knitting needles 2. On the other hand, the cam arrangement 20 has cam parts 23, as well as swivelling cam parts 24 and 25. The cam parts 23 are provided with guide tracks 26 for the control butts 14 of sinkers 7 and, like them, serve for movement of the sinkers 7 in the longitudinal direction v. On the other hand, the swivelling cam parts 24, 25 serve the purpose of pivoting the sinkers 7 in the transverse direction w, wherein the upper swiveling cam parts 24 acting on the rocking elements 15 cause a pivot movement of the heads 17 of sinkers 7 radially inward into the latch clearing position, apparent from FIG. 1, and the lower swivelling cam parts 25 acting on the rocking elements 16 cause a pivot movement of the heads 17 radially outward into a knock-over position.

Additional details of such circular knitting machines, their parts, and especially their method of operation, are known generally to one skilled in the art, for example, from documents DE 33 11 361 C2 and DE 33 48 030 C2, to which reference is made here as an object of the present disclosure, and therefore need not be further explained.

Figure 4:
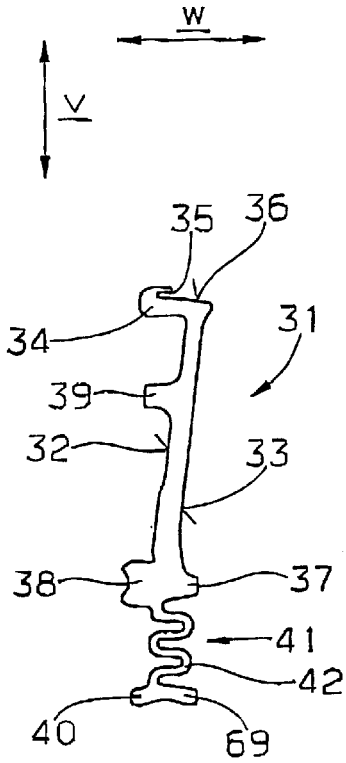
FIG. 4 shows the side view of a sinker according to the invention for the circular knitting machine according to FIG. 1.
Figure 5:
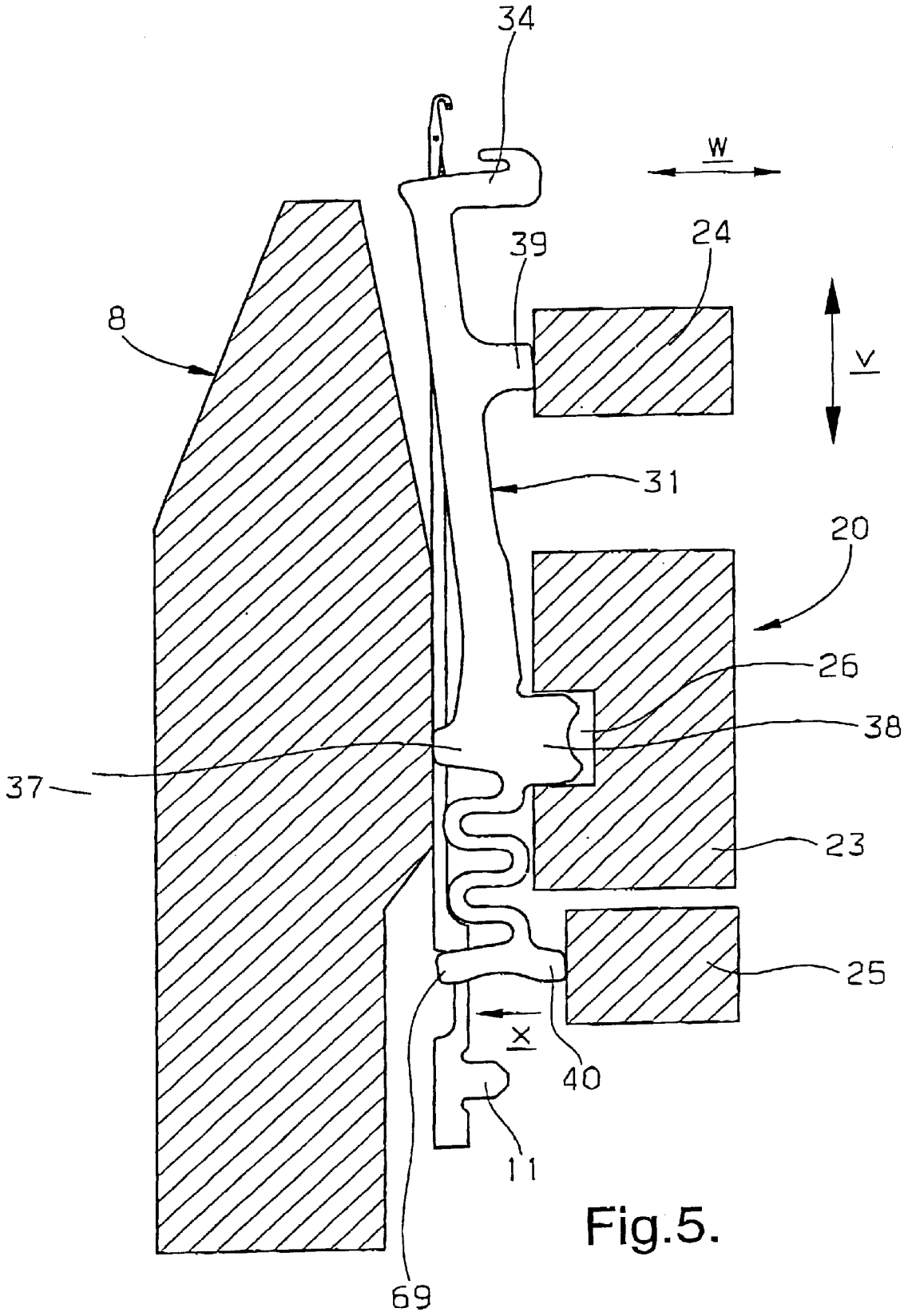
FIG. 5 shows an enlarged schematic section similar to FIG. 1, but with the sinkers according to FIG. 4 and only with the parts essential to the invention.
Figure 6:
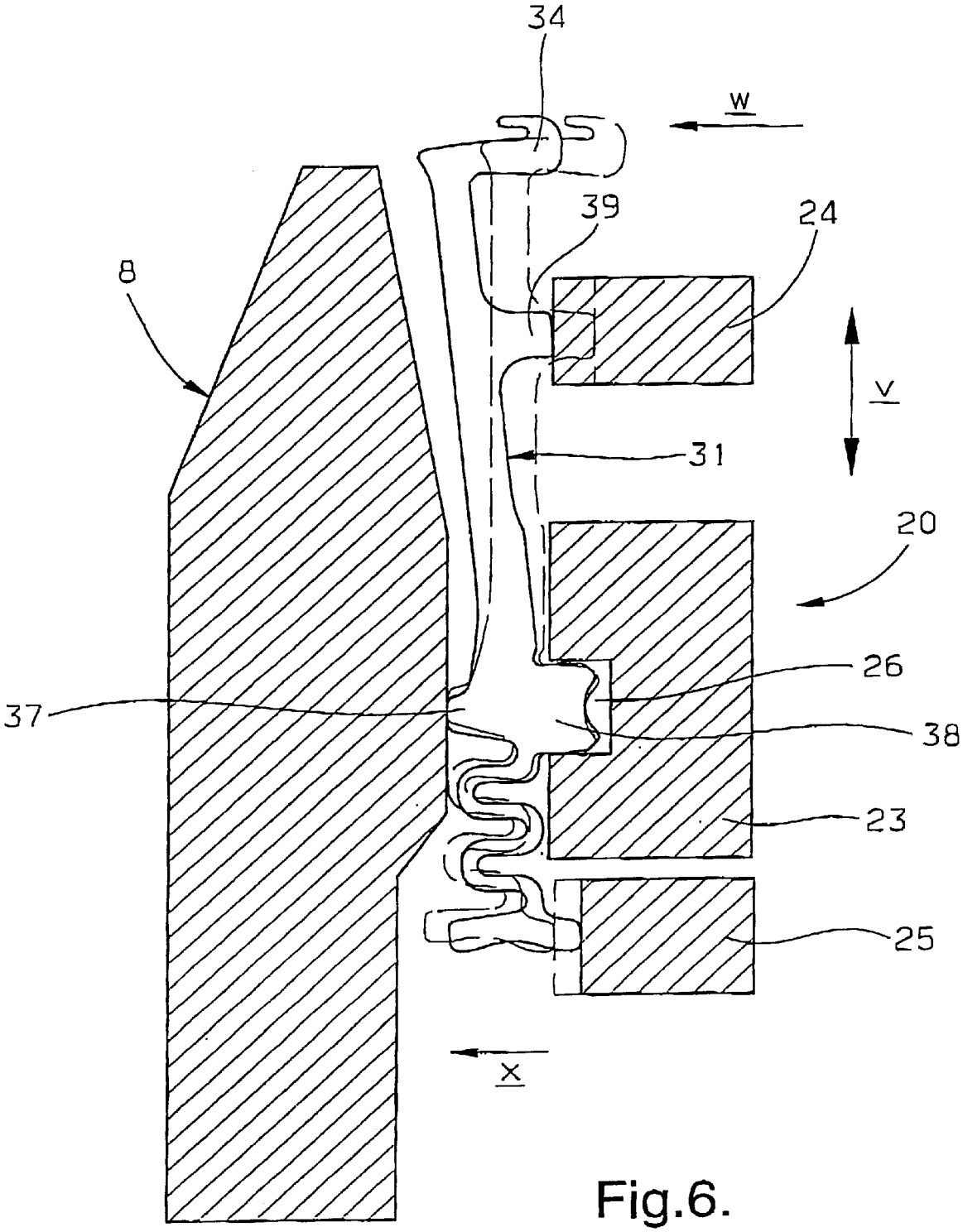
FIG. 6 shows a section according to FIG. 5 with two different sinker positions.

FIG. 4 shows a sinker 31 according to the invention, also apparent from FIGS. 5 and 6, and according to an embodiment deemed to be the best one up to now. Like the sinkers 7 according to FIG. 1, it contains a front side 32, a back side 33, a head 34 on one end with a sinker throat 35 and a knock-over edge 36, a central bearing site 37 protruding from back side 33, a control butt 38 arranged at the level of bearing site 37 but protruding from the front side 32, and rocking elements 39 and 40 on both sides of it, which are also designed as butts protruding from front side 32. According to the invention, the sinker 31 also has a spring element 41, which acts particularly transversely to the longitudinal direction corresponding to the longitudinal direction v according to FIG. 1, i.e., parallel to the side walls of guide webs 6 and therefore in the direction of arrow w in FIG. 1. The spring element 41, in the embodiment according to FIGS. 1 and 4, consists of an elastic shank section 42 designed undulating or snake-like and being arranged between the control butt 38 and the (lower) rocking element 40 that lies on the side of control butt 38 facing away from head 34. As an alternative, the shank section 42 could also be designed meander-like.

FIGS. 5 and 6, in which the same reference numbers as in FIGS. 1, 2 and 3 are used for the same parts, show the sinker 31 in the mounted state with and without the knitting needle 3. The bearing site 37 then lies on carrier arrangement 8, for example, on the bottom of a groove thereof which accommodates sinker 31 and which, in similar fashion to FIG. 1, is formed from webs (not shown), whereas the upper swivelling cam part 24 abuts the rocking element 39 and the lower swivelling cam part 25 abuts the rocking element 40 of sinker 31. The arrangement according to the invention is then such that the sinker 31 is slightly biased elastically, i.e., the shank section 42 is bent somewhat elastically in the direction of arrow x relative to its normal position in the not mounted, unbiased state.

In known arrangements of this type (for example, DE 33 11 361 C2), sinkers are used that are essentially rigid and resistant to bending in the transverse direction w. In order to avoid strong friction or even rupture of the sinkers because of unavoidable manufacturing tolerances, especially in the region of the surfaces acting on the rocking elements 39, 40, it thus far had to be ensured in the mounted position of the sinkers apparent from FIG. 5 that the sinkers are mounted in the transversely direction w with a certain play of, say, 0.2 to 0.5 mm, pivotable back and forth, i.e., a narrow gap is present between at least one swivelling cam part 24, 25 and the corresponding rocking element 39, 40. Such an adjustment is no longer required according to the invention. Because of the spring force inherent to spring element 41, the sinker 31 is forced, on the one hand, at its sites 37, 39 and 40 with a certain bias against carrier arrangement 8 and the swivelling cam parts 24, 25, whereas, on the other hand, radial inaccuracies, for example, of the swivelling cam parts 24, 25 or of carrier arrangement 8 are compensated by means of corresponding pivot movements of the sank sections 42 that occur radially against the spring force or with the spring force. Because of this, all manufacturing and shape tolerances of carrier arrangement 8, swivelling cam parts 24, 25 and sinkers 31 can be fully compensated. It is only necessary to apply the shank sections 42 to the sinkers 31 so that they are biased or elastically bent during ordinary incorporation by the amount of the otherwise ordinary play of 0.2 to 0.5 mm. In addition, the spring element 41 is preferably designed so that it is as resistant to bending as possible in FIG. 5 in a direction perpendicular to the plane of the drawing, so that radial bending to the required extent, but, if possible, limited bending perpendicular to it can occur, i. e. in a direction than runs perpendicular to the needle movement and perpendicular to the side walls of the guide webs 6.

FIG. 6 shows the two possible extreme pivot positions of sinkers 31 in a position depicted with a solid line and a dashed line. It is apparent from this that the tolerance compensation is independent of the pivot position of sinkers 31 present in an individual case.

Figure 7:
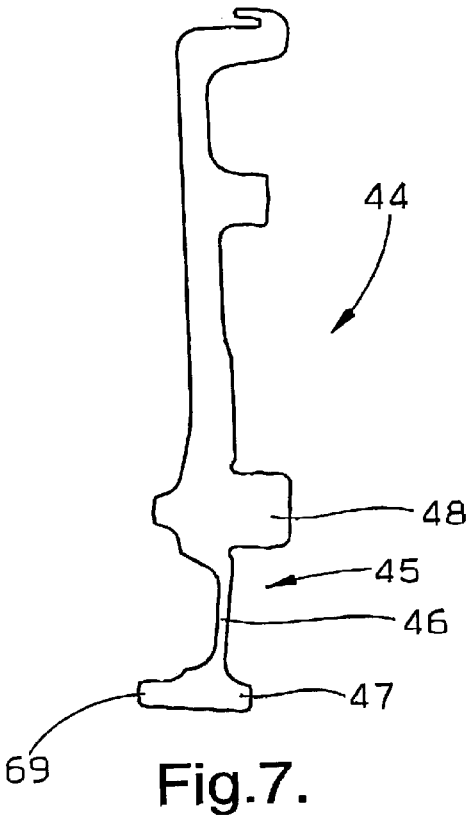
FIGS. 7 to 9 show three additional practical examples of the sinker according to the invention, each in a side view according to FIG. 4.

FIG. 7 shows, as a second embodiment, a sinker 44 according to the invention, in which a spring element 45 is obtained by a shank section 46 that is sufficiently narrow, at least in pivot direction w, and, as in the case of FIGS. 4 to 6, permits elastic pivoting of a lower rocking element 47 relative to a middle control butt 48 in the direction of arrow x (FIG. 5). In this practical example, the sinker 44 is thus also designed elastically between the middle control butt 48 and the lower rocking element 47.

Figure 8:
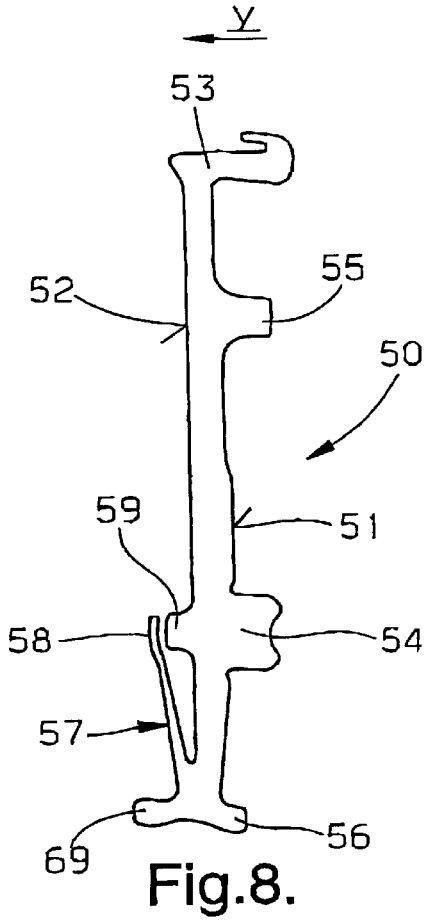

In the embodiment according to FIG. 8, a sinker 50 according to the invention again contains a front 51, a back 52, an ordinary head 53 on one end, a middle control butt 54 and rocking elements 55 and 56 formed on both sides thereof as butt. A spring element 57, which is designed as an elastic tab protruding from back 52 and is molded onto the back 52 of sinker 50 in the region of the rocking elements 56 remote from head 53, extends rearward from the back 52 and in the direction of control butt 54. The spring element 57 has a slightly bent support site 58 on its free end, which, in the mounted state, similar to FIGS. 5 and 6, serves for support on carrier arrangement 8 or the bottom of a corresponding groove. The radial position of support site 58 relative to the front edges of rocking elements 55 and 56 is chosen in similar fashion to the embodiment according to FIGS. 4 to 7, so that it is supported on carrier arrangement 8 in the mounted state of sinker 50, i.e., when the rocking elements 55, 56 lie against the corresponding swivelling cam parts 24, 25, and the spring element 57 is then slightly biased elastically, so that the rocking elements 55, 56 are forced against the corresponding swivelling cam parts 24, 25 with compensation of any manufacturing tolerances, always with slight bias and free of play, The position of support site 58, viewed in the longitudinal direction according to arrow v in FIG. 5, is also chosen so that the rocking elements 55, 56 are forced as uniformly as possible against the swivelling cam parts 24, 25 and no undesired tilting moments develop. In the practical example, the support site 58 lies roughly at the level of control butt 54, The spring force is therefore created in this variant, in contrast to FIGS. 4 to 7, by the fact that the essentially continuously rigid sinker 50, with resistance to bending, is provided with an additionally present elastic tab.

In the embodiment according to FIG. 8, it is theoretically conceivable that the head 53 of sinker 50 is pivoted in the direction of an arrow y, because of forces that are exerted on it by a thread or the like during knitting, which could adversely affect the knitting process. The sinker 50 is therefore provided on its back 52 with a limitation device 59 limits its pivotability or its possible pivot stroke. In the embodiment, this device 59 consists of a shoulder on the sinker shank that protrudes from the back 52 and abuts the spring element 57 or its support site 58 after a preselected pivot stroke in the direction of arrow v. An additional pivoting of sinker 50 in the direction of arrow v is then no longer possible. Otherwise, the fiction of sinker 50 is similar to that of sinkers 31 and 44.

In the previous embodiments, the sinkers have two rocking elements cooperating with the corresponding cam parts 24, 25 and a control butt lying between the rocking elements for the movement occurring in the longitudinal direction. On the other hand, FIGS. 9 and 10 show a variant, in which one of the rocking elements and the corresponding swivelling cam part can be avoided.

Figure 9:
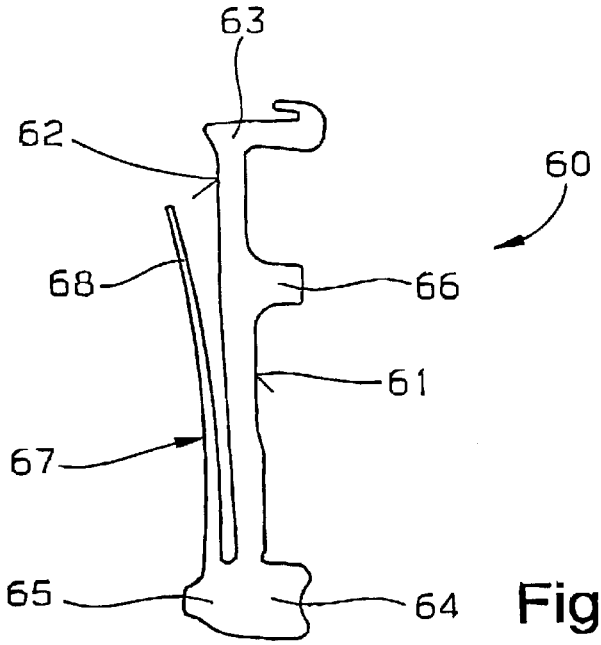
Figure 10:
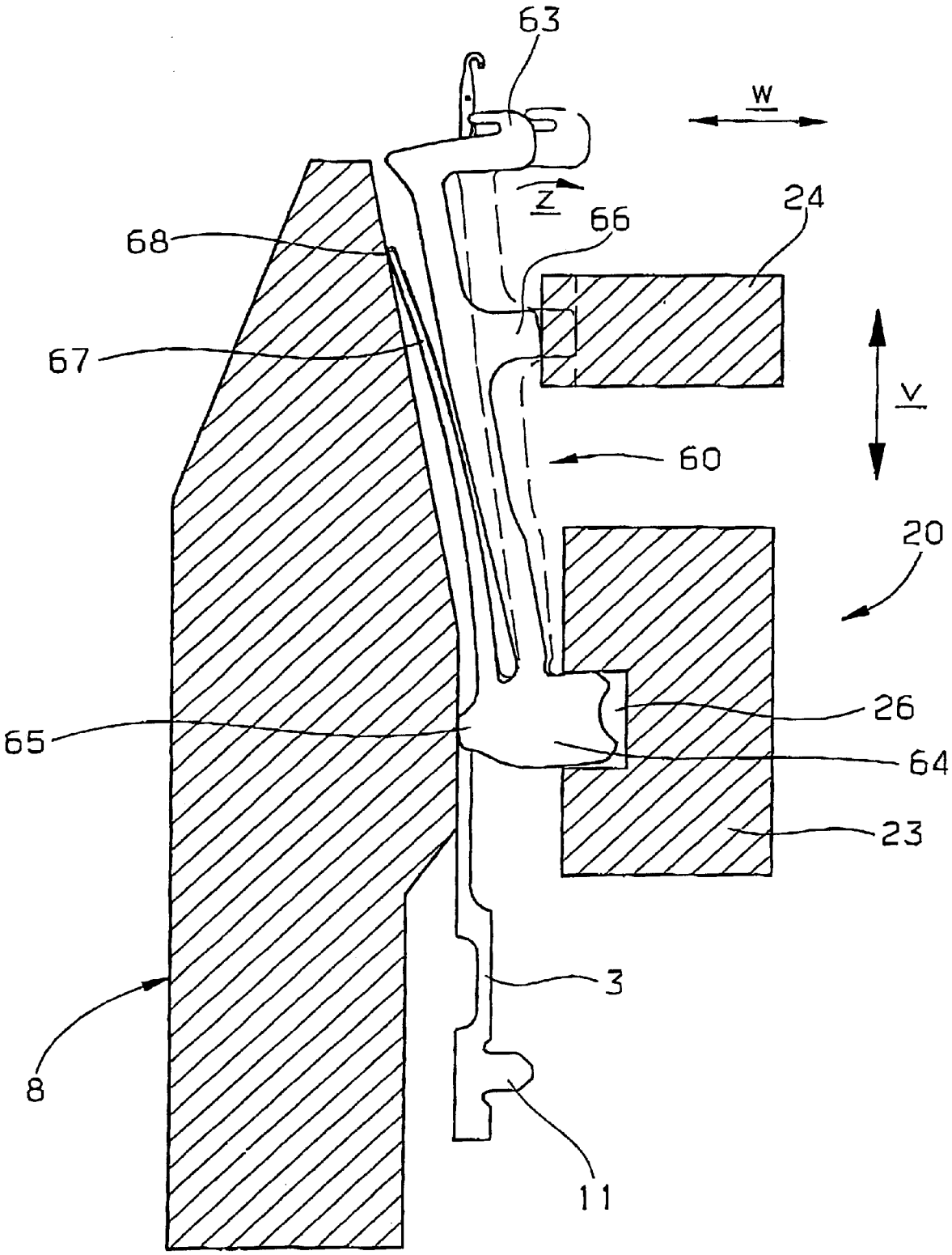
FIG. 10 shows a section according to FIG. 5, but through a circular knitting machine equipped with a sinker according to FIG. 9.

A sinker 60 according to FIGS. 9 and 10 contains a front 61, a back 62, an ordinary head 63 on one end, a control butt 64 protruding from the front on the opposite end, a bearing site 65 designed as a protruding shoulder and applied on the back of control butt 64 and a rocking element 66 situated on the front 61, designed as a butt and positioned between head 63 and control butt 64. As in FIG. 6, a spring element 67 designed as an elastic tab is provided in the region of the control butt 64, is molded onto the sinker 60, protrudes rearward from the sinker 60 and extends from control butt 64 in the direction of head 63.

As shown in FIG. 10, in particular, in which the same parts are denoted with the same reference numbers as in FIGS. 1 to 6, the beating site 65 in the mounted state of sinker 60 is supported on carrier arrangement 8 or on the bottom of a trick made in it, whereas, on the other hand, the swivelling cam part 24 lies against rocking element 66. At the same time, the spring element 67 is supported by means of a support site 68 situated on a free end on carrier arrangement 8 with slight elastic bias. In contrast to the previous embodiments, and especially in contrast to FIG. 8, the axial position of the support site 68 in the longitudinal direction v is chosen so that the spring element 67 exerts a slight tilting moment or torque in the direction of arrow z on sinker 60 and seeks to pivot it around bearing site 65, so that, on the one hand, the rocking element 66 is forced against the swivelling cam part 24 and, on the other hand, the bearing site 65 is forced against carrier 8 with elastic bias. Because of this, me spring element 67 compensates for the manufacturing tolerances, as in the other embodiments. However, at the same time, the sinker 60 is also held securely in contact with the swivelling cam part 24 and corner arrangement 8 when the sinker 60 is pivoted from the clearing position, depicted in FIG. 10 by a solid line, into the knock-over position, shown in FIG. 10 with the dashed line, and the swiveling cam part 24 (or its guide curve lying against the pivot site 66), viewed from carrier arrangement 8, gradually recedes radially outward. The sinker 60 is then pivoted by the force of the spring element 67 into the opposite knock-over position. In the embodiment, the support site 68 is arranged for this purpose in the longitudinal direction v between head 63 and rocking element 66 of sinker 60. Further the spacing between the back 62 of sinker 60 and the spring element 67 can be chosen so that the sinker 60 can be pivoted only by a preselected stroke in a direction opposite arrow z (FIG. 10), in order to achieve the same effect that the limitation device 59 contributes in the embodiment according to FIG. 8.

As an alternative to the embodiment according to FIGS. 9 and 10, it would be possible to arrange the bearing site 65 situated on the back between the head and a lower rocking element, and to provide the spring element with a support site that lies on the side facing away from this rocking element. In this case as well, a torque is produced that seeks to force the rocking element against a pivot cam part arranged at appropriate height and to force the bearing site against the carrier arrangement.

Advantages of the described sinkers consist, in particular, of a guiding free of play and a resulting vibration-free running, which, in turn, results in high running quietness and reduced heat development.

The invention is not restricted to the described embodiments, which could be modified in a variety of ways. In particular, it is possible in the embodiments according to FIGS. 1 to 7 to choose the thickness and/or width of the sinkers in the region of the elastic shank section so that the desired elastic force effects are obtained and the friction force produced and the heat development caused by this remain as low as possible. Accordingly, in the variants according to FIGS. 7 to 10, the width and/or thickness and/or axial length of the spring elements 57, 67 can be set so that the most favorable spring forces are obtained in individual case. The width and/or thickness of the sinkers can also be chosen in other regions, especially on shank sections lying between the upper rocking elements and the control butts, smaller than in the region of the other parts, in order to reduce their weight and keep the required spring forces low. The sinkers are also provided in the region of the lower rocking elements, preferably with rearward protruding guide shoulders 69 (FIGS. 4, 5, 7 and 8), which come to lie in the mounted state between the guide webs or the like present in the corresponding carrier arrangement 8 and improve lateral guiding of the sinkers, i.e., prevent rotational movements around the sinker longitudinal axis. It would also be possible to design the sinker 44 elastic in the entire shank region situated between the two rocking elements in the fashion of a convex arc, in which case the crest of the arc would serve as bearing site, the ends of the arc could have the rocking elements, and the entire shank section would be designed elastic. It is also clear that the spring elements depicted in FIGS. 8 to 10 can also be configured differently and arranged on different sites of the sinkers, it being also possible to produce the spring elements from spring wire and then fasten them to the sinkers. The position of the control butts relative to the bearing sites can also be chosen differently. Corresponding sinkers and swivelling cam parts can also be provided in knitting machines that do not operate according to the relative technique, and in which the sinkers are to be pivotable in the manner just described for other reasons. Finally, it is understood that the different features can also be used in combinations other than those depicted and described.

It will be understood that each of the elements described above, or two ore more together, may also find a useful application in other types of constructions differing from the types described above.

While the invention has been illustrated and described as embodied in a circular knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set froth in the appended claims.

What is claimed is:

1. Sinker for a knitting machine comprising: a front (12, 32, 51, 61), a back (9, 33, 52, 62), a head (34, 53, 63) arranged on one end and having a sinker throat (35) and a knock-over edge (36), a control butt (38, 54, 64) for enabling movements in a longitudinal direction (v) and protruding from the front (12, 32, 51, 61), at least one rocking element (39, 40, 55, 56, 66) for enabling pivot movements transverse to the longitudinal direction (v) and provided on the front (12, 32, 51, 61) and a spring element (41, 45, 57, 67) acting transversely to the longitudinal direction (v).

2. Sinker according to claim 1, wherein said rocking element (66) is arranged between said head (63) and a bearing site (65) supported on a carrier arrangement (8) and provided on the back (62), wherein said spring element (67) has a support site (68) arranged between said head (63) and a pivot site (66).

3. Sinker according to claim 1, wherein a bearing site intended for support on a carrier arrangement (8) and provided on the back is arranged between said head and said rocking element, wherein sad spring element has a support site for being supported on said carrier arrangement, said support site lying on a side of said rocking element facing away from said bearing site.

4. Sinker according to claim 1, and further comprising two rocking elements (55, 56) arranged on the front (51) and spaced in the longitudinal direction (v), wherein said spring element has a support site (58) supported on a carrier arrangement (8) and being arranged in the longitudinal direction (v) between the two rocking elements (55, 56).

5. Sinker according to claim 2, and further having a limiting device (59) that limits pivotability of said sinker.

6. Sinker according to claim 2, and further having a limiting device (59) that limits its pivotability of said sinker, wherein said limiting device (59) a shoulder protruding from the back and contacting said spring element (57).

7. Sinker according to claim 1, and further being provided with two rocking elements (39, 40 or 47) spaced in the longitudinal direction (v) and arranged on the front (32), and a bearing site (37) situated in the longitudinal direction (v) between said rocking elements, but on the back (33).

8. Sinker according to claim 7, wherein said spring element (41, 45) comprises an elastic shank section (42, 46) arranged between said rocking elements (39, 40 or 47).

9. Sinker according to claim 7, wherein said control butt (38, 48) is arranged between the two rocking elements (39, 40 or 47) and wherein said spring element (41, 45) comprises an elastic shank section (42, 46), said elastic shank section arranged between said control butt (38, 48) and wherein one of said rocking elements (40, 47) lies on a side of said control butt (38, 48) facing away from said head (34).

10. Sinker according to claim 9, wherein said spring element (41) comprises a wavy shank section (42).

11. Sinker according to claim 8, and having at least partially a reduced width or thickness in a region of said spring element (41) relative to other sections.

12. Sinker according to claim 1, wherein said spring element (41, 45, 57, 67) is molded onto said sinker.

13. Sinker according to claim 1, wherein said sprig element (57, 67) comprises an elastic tab protruding from the back (52, 62).

14. Sinker according to claim 1, wherein said rocking elements (39, 40 or 47) comprise butts protruding from the front (32).

15. Knitting machine comprising: a carrier arrangement (8), wherein knitting needles (3) and knock-over and holding down sinkers (6) are arranged in alternation next to each other, and a cam arrangement (20) for relative displacement of the knitting needles (3) and sinkers (60) in a longitudinal direction (v), and for pivoting of the sinkers (60) transversely to said longitudinal direction, wherein said sinkers (60) are each provided with two rocking elements (55, 56) arranged on a front side of said sinker and spaced in the longitudinal directive (v), said sinkers each having a spring element (57) with a support site (58) supported on said carrier arrangement (8), wherein said sinkers are arranged in the longitudinal direction (v) between the two rocking elements (55, 56), said cam arrangement (20) having a swivelling cam part (24) allocated to said rocking elements (66) and wherein the sinkers (60) lie against said swiveling cam part (24) with their rocking elements (66) and against said carrier arrangement (8) with their bearing sites (65) under a bias caused by said spring elements (67).

16. Knitting machine comprising: a carrier arrangement (8), wherein knitting needles (3) and knock-over and holding down sinkers (50) are arranged in alternation next to each other, and a cam arrangement (20) for relative displacement of the knitting needles (3) and sinkers (50) in a longitudinal direction (v), and for pivoting of the sinkers (50) transversely to the longitudinal direction (v), wherein said sinkers (50) each have a head (63) and a bearing site (65) supported on said carrier arrangement, wherein said sinkers each include at least one rocking element (39, 40, 55, 56, 66) arranged between said head (63) and said bearing site (65) and provided on a back side of each said sinker, each said sinker including a spring element (67), wherein said spring element (67) has a support site (68) arranged between said head (63) and a pivot site, said sinkers each having a limiting device (59) that limits pivotability, said limiting device (59) comprising a shoulder protuding from the back side and designed to contact said spring element (57), wherein said cam arrangement (20) has two swivelling cam parts (24) each being allocated to one of said rocking elements (55, 56), and the rocking elements of the sinkers are biased free of play against the swivelling cam parts (24, 25) by means of said spring elements (57) supported on said carrier arrangement.

17. Knitting machine comprising; a carrier arrangement (8), wherein knitting needles and knock-over and holding down sinkers (31, 44) are arranged in alternation next to each other, and a cam arrangement (20) for relative displacement of the knitting needles (3) and sinkers (31, 41) in a longitudinal direction (v), and for pivoting of the sinkers (31, 44) transversely to the longitudinal direction (v), wherein each said sinker (31, 44) has a spring element and is provided with two rocking elements (39, 40 or 47) spaced in the longitudinal direction (v) and arranged on a front (32) of said sinker, each sinker having a bearing site (27) situated in the longitudinal direction (v) between said rocking elements, but on a back of said sinker (33), each sinker having a controll butt arranged between the two rocking elements (39, 40 or 47) and wherein said spring element (41, 45) comprises an elastic shank section (42, 46) arranged between said control butt (38, 48), and wherein one of the rocking elements (40, 47) lies on a side of said controll butt (38, 48) facing away from a head of each sinker, wherein the cam arrangement (20) has two swivelling cam parts (24, 25), each being allocated to one of said rocking elements (39, 40), wherein the bearing sites (37) of the sinkers (31, 44) lie against said carrier arrangement and the rocking elements (39, 40) of sinkers (31, 41) are biased free of play against the swivelling cam parts (24, 25) by elastic bending of said spring element (41, 45).

* * * * *